US007104929B1

(12) United States Patent
Eschenbach

(10) Patent No.: US 7,104,929 B1
(45) Date of Patent: Sep. 12, 2006

(54) ADJUSTABLE ELLIPTICAL EXERCISE MACHINE

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 64 days.

(21) Appl. No.: 11/071,019

(22) Filed: Mar. 3, 2005

(51) Int. Cl.
*A63B 69/16* (2006.01)
*A63B 22/04* (2006.01)

(52) U.S. Cl. ..... 482/52; 482/57

(58) Field of Classification Search ..... 482/51–52, 482/57, 70, 79–80
See application file for complete search history.

(56) References Cited

U.S. PATENT DOCUMENTS

| | | | | |
|---|---|---|---|---|
| 5,957,814 A | | 9/1999 | Eschenbach | 482/51 |
| 5,993,359 A | * | 11/1999 | Eschenbach | 482/57 |
| 5,997,445 A | | 12/1999 | Maresh et al. | 482/70 |
| 6,042,676 A | * | 3/2000 | Stein | 156/239 |
| 6,168,552 B1 | | 1/2001 | Eschenbach | 482/52 |
| 6,422,976 B1 | * | 7/2002 | Eschenbach | 482/52 |
| 6,422,977 B1 | * | 7/2002 | Eschenbach | 482/52 |
| 6,440,042 B1 | * | 8/2002 | Eschenbach | 482/52 |
| 6,612,969 B1 | * | 9/2003 | Eschenbach | 482/51 |

* cited by examiner

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet. Elliptical cross trainers guide the feet along a generally elliptical shaped curve to simulate the motions of jogging and climbing. Existing elliptical cross trainers often use excessive pedal articulation which can overwork the ankle to achieve a longer stride. The present invention is an improved elliptical exercise machine capable of extended exercise with less pedal articulation that is more ankle friendly. One end of a foot support member has a pedal which follows elliptical motion while the other end is guided by a drive link to drive an alternator and flywheel. The resulting pedal motion is foot friendly. Handles are coordinated with the foot support members for arm exercise. Both the stride length and orientation of the pedal ellipse are adjustable.

20 Claims, 3 Drawing Sheets

ADJUSTABLE ELLIPTICAL EXERCISE MACHINE

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet. The elliptical path provided by the pedals is adjustable in length and orientation.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for an elliptical exercise machine capable of a similar long stride using a linkage to modify a shorter crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Eschenbach in U.S. Pat. No. 5,957,814 shows the use of an orbital link in a front drive elliptical design. Maresh et al. in U.S. Pat. No. 5,997,445 shows elliptical exercise with an adjustable track supporting a roller positioned midway along the foot support member. Eschenbach in U.S. Pat. No. 6,168,552 also shows elliptical exercise with an adjustable track with a roller positioned intermediate the ends of a foot support member with arm exercise added. Eschenbach in U.S. Pat. No. 6,440,042 offers elliptical exercise having adjustable stride and adjustable ellipse orientation.

There is a need for a pedal operated exercise machine that can be safely operated in the standup position whereby the arms and legs can be exercised with the feet moving through a generally elliptical movement without excessive pedal articulation as well as adjustable stride and adjustable ellipse orientation.

It is one objective of this invention to provide an elliptical pedal movement with a path generating linkage that provides a long stride with less pedal articulation. Excessive pedal articulation causes ankle stress. Another object of this invention is to provide arm exercise that is coordinated with the pedal movement. Another objective of this invention is to provide a simple means of stride and ellipse orientation adjustment.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an elongate curve motion while pedal angles vary during the pedal cycle to maintain the heel of the foot in contact with the pedal with less pedal articulation. As the foot is raised, the heel of the foot remains generally in contact with the inclining pedal for safer operation. Arm exercise is by arm levers coordinated with the mechanism guiding the foot pedals.

In the preferred embodiment, the apparatus includes a separate pedal for each foot, each pedal being positioned at one end of a foot support member and partially supported by an elongate guide path at the first portion of the foot support member. The elongate guide path generating linkage has a rotary crank arm which completes one full revolution during a pedal cycle and is phased generally opposite the crank arm for the other pedal through a crankshaft pivot axis attached to the framework. A rocker link is connected at a rocker pivot to a stride adjustment link which is connected to the framework. A coupler link is connected to the crank at a crank arm pivot and the rocker link is connected to the coupler link at a pivot to form a crank-rocker mechanism where the rocker link oscillates about the rocker pivot when the crank rotates. A drive link is also connected to the crank arm pivot with the addition of a connector link pivotally connected to the drive link and to the rocker link. The combination of crank arm, coupling link, rocker link, connecting link and drive link form a path generating linkage with each end of the drive link following elongate curves.

A second portion of the foot support member is supported with a pivot by a roller positioned intermediate the foot support member and in rollable contact with a guide. As the crank arms are driven by foot motion, the pedals follows an elongate curve approximating an ellipse having less pedal articulation than other elliptical cross trainers having long crank arms.

Arm exercise is provided with handles pivotally connected to the framework and coordinated with the rocker links. When the foot is forward, the handle corresponding to that foot is generally rearward.

Load resistance is imposed upon the crank arms through pulleys and belts from a flywheel and alternator. A control system regulates the load on the alternator to vary the resistance to exercise. The resistance can be varied during operation through a control system within easy reach of the operator. Other forms of load resistance such as friction, magnetic, air, belt, etc. may also be used.

A first actuator is provided to move the stride adjustment link which causes the rocker pivot of the rocker link to move along one end of the rocker link. This is accomplished with a gear centered about the rocker pivot on a gear shaft and a gear rack attached to the rocker link. A toothed belt and a pair of toothed belt gears cause the gear shaft to rotate when the stride adjustment link is moved such that the gear rotates along the rack. The relocation of the rocker pivot changes the stride length of the pedals. The stride length can be changed during operation or when the apparatus is stationary.

A second actuator causes one end of the guide track to move which changes the orientation of the pedal ellipse. The first and second actuators may be operated independently by manual control or through programming of the control system.

In summary, this invention provides the operator with stable foot pedal support having motions that simulate running, climbing and cycling with very low joint impact and upper body exercise. The pedal motion exhibits a long stride with less pedal articulation common to other elliptical trainers for less ankle stress. Simple adjustment of stride length and pedal ellipse orientation are provided.

DETAILED DESCRIPTION OF THE EMBODIMENTS

Figure 1:
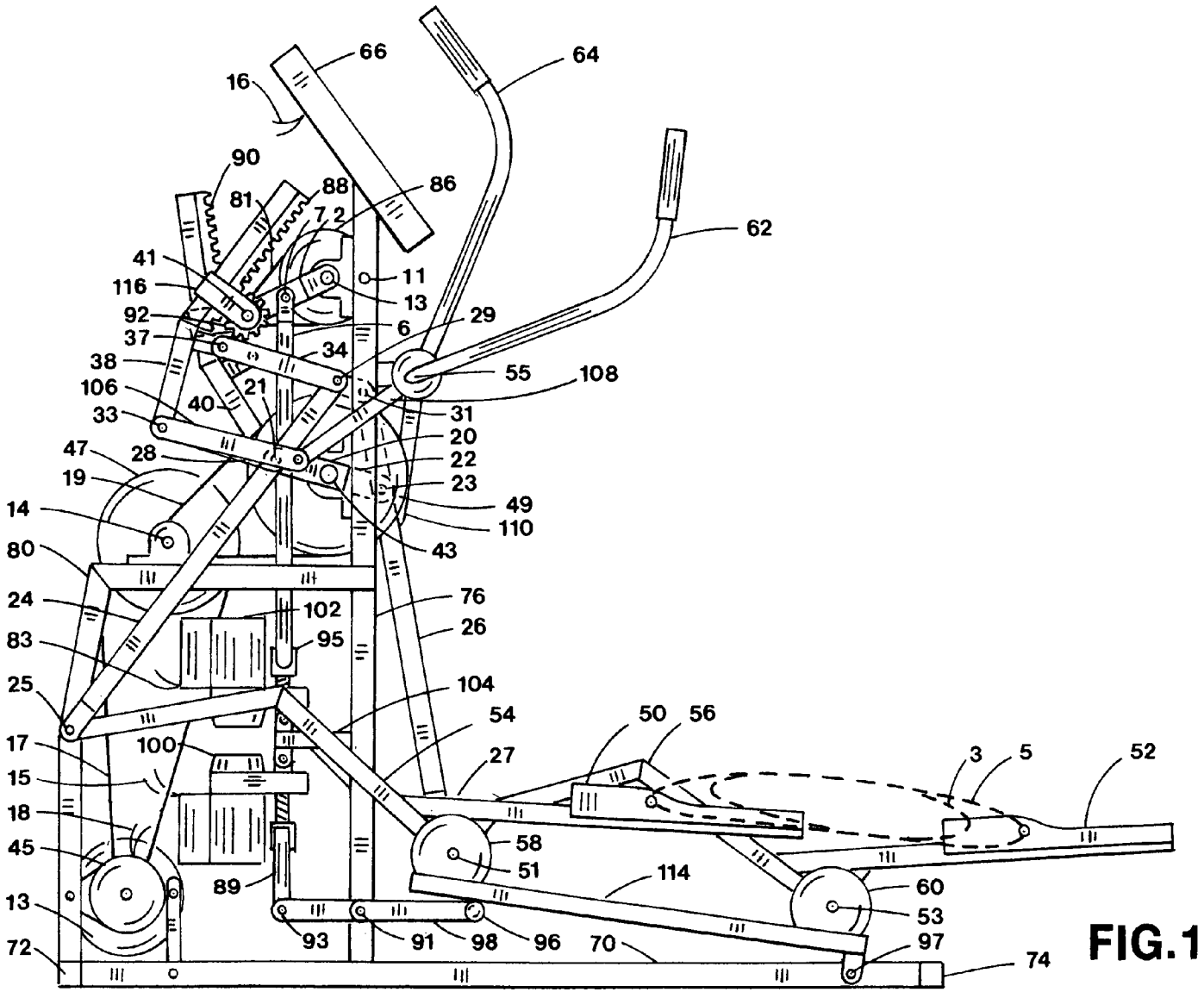
FIG. 1 is a right side elevation view of the preferred embodiment of an exercise machine constructed in accordance with the present invention.
Figure 2:
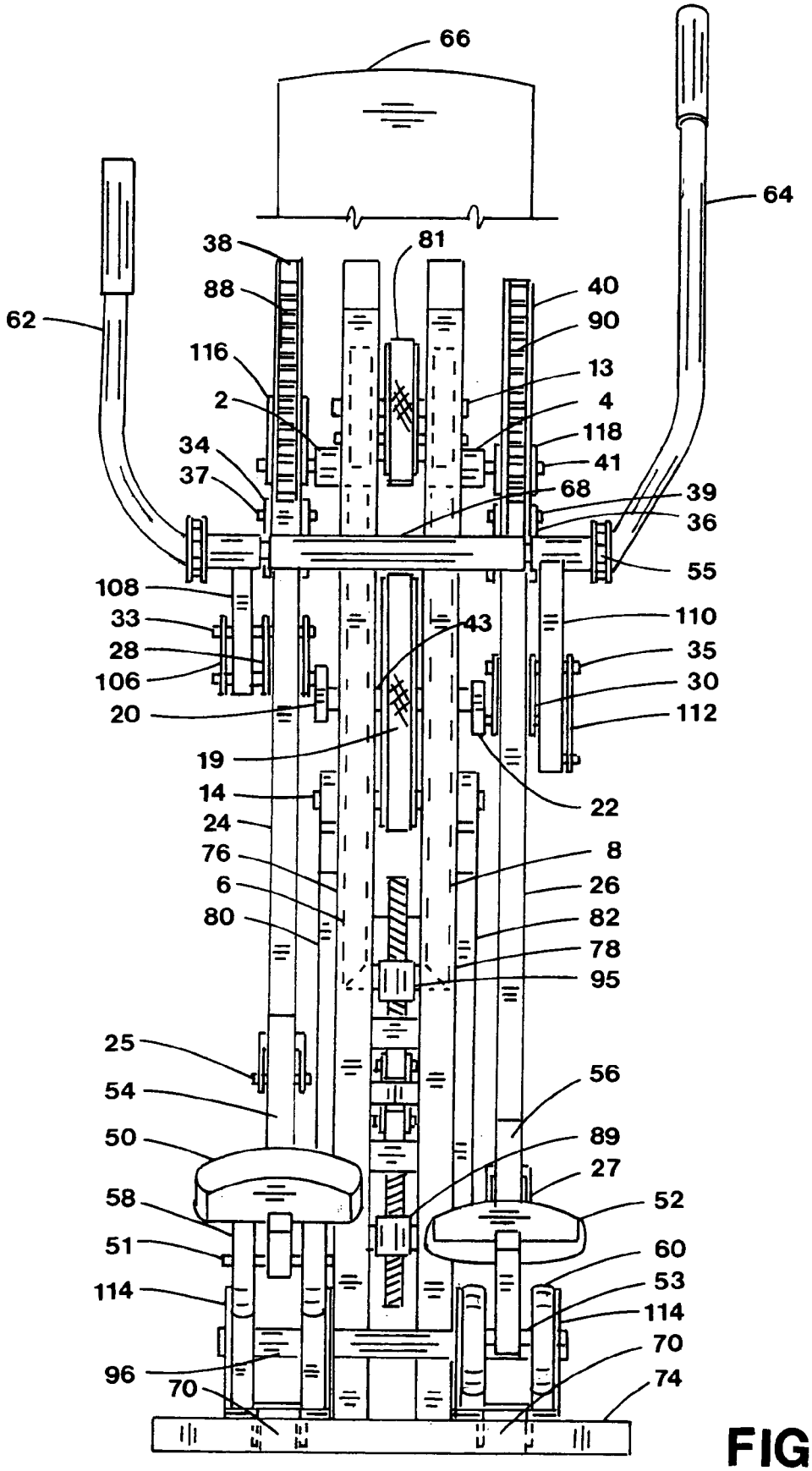
FIG. 2 is the rear view of the preferred embodiment shown in FIG. 1.

Referring to the drawings in detail, pedals 50 and 52 are shown in FIGS. 1 and 2 in the most forward and rearward positions of the preferred embodiment. Pedals 50 and 52 are supported by foot support members 54 and 56 and traverse an elongate closed loop path 5. Foot support members 54,56 are connected to drive links 24,26 at pivots 25,27 and supported by rollers 58,60 positioned intermediate the ends at pivots 51,53. Rollers 58,60 are in rollable contact with guides 114.

Drive links 24,26 are connected to crank arms 20,22 intermediate the ends at pivots 21,23. Crank arms 20,22 are joined as generally opposed at pivot axis 43 to form a crank. Rocker links 38,40 are connected to stride adjustment members 2,4 at gear shaft 41 and to coupler links 28,30 at pivots 33,35. As crank arms 20,22 complete a revolution, rockers 38,40 oscillate about gear shaft 41 acting as a pivot.

Connector links 34,36 are connected to rocker links 38,40 at pivots 37,39 and to drive links 24,26 at pivots 29,31. Drive links 24,26, cranks arms 20,22, rocker links 38,40, coupler links 28,30 and connector links 34,36 form a pair of path generating linkages configured to guide the first portion of the foot support member 54,56 proximate pivots 25,27 along an elongate path (not shown for clarity). Pivots 29,31 also follow elongate paths. For this embodiment, note that the elongate path followed by the end of foot support members 54,56 does not orbit pivot axis 43.

Handles 62,64 are pivoted to frame member 68 for arm exercise. Handle links 108,110 are attached to handles 62,64 and pivotally connected to handle connectors 106,112. Handle connectors 106,112 are connected to rockers 38,40 at pivots 33,35.

Pulley 49 is attached to crank arms 20,22 and rotates about pivot axis 43 to drive alternator 45 and flywheel 13 through belts 17,19 and step-up pulley 47. Alternator 45 is supported by frame 70 and is connected to controller 66 by wires 16,18 using conventional wiring (not shown). Controller 66 is attached to frame members 76,78 and works with alternator 45 to provide variable resistance to exercise using conventional methods.

Crank pivot axis 43 is supported by upright members 76,78 which are attached to frame member 70. Cross members 72,74 are supported by the floor and attach to frame member 70. Pulley 47 is supported by a pulley supports 80,82 at pivot 14 which are attached to frame member 72 and 76,78. Frame member 68 is attached to frame members 76,78 to support handle pivot 55.

Guide track 114 is connected to frame member 70 at pivot 97 and supported by support bar 96. Support bar 96 is attached to track link 98 that is connected to frame members 76,78 at pivot 91. Actuator 100 is connected to frame member 104 and with screw adapter 89 connected to track link 98 at pivot 93. Wires 15 are connected to controller 66 with wires 16 by conventional means (not shown). The controller 66 can be programmed in various ways to activate the actuator 100 which will raise or lower the forward ends of tracks 114 which will change the orientation of elongate curves 3 and 5.

Figure 3:
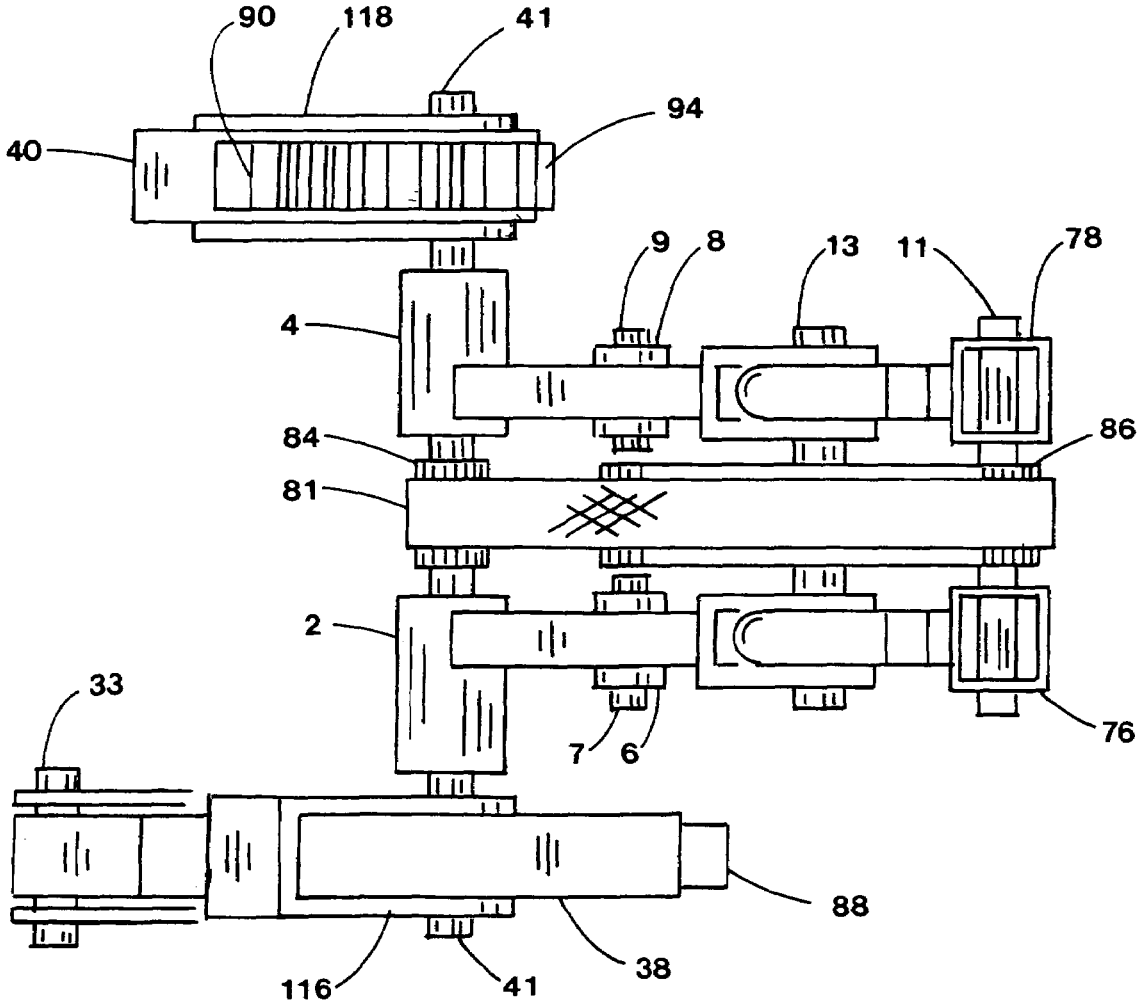
FIG. 3 is a top view of the stride adjustment of the preferred embodiment of the present invention.

The length of stride is independently adjustable through actuator 102 which is attached to the frame 104 to operate stride screw adapter 6,8. Stride adjustment links 2,4 are connected to frame members 76,78 at pivot shaft 13. Stride screw adapters 6,8 are connected to stride adjustment links 2,4 at pivots 7,9 as shown in FIG. 3. Gear shaft 41 runs through stride adjustment links 2,4 to support gears 92,94. Gears 92,94 are meshed with gear racks 88,90 that are attached to rocker links 38,40. Collars 116,118 are rotatably connected to gear shaft 41 to maintain gear racks 88,90 in contact with gears 92,94. Collars 116,118 are in sliding contact wit rocker links 38,40.

Toothed belt gear 84 is attached to gear shaft 41 and engaged with toothed belt 81. Larger toothed gear 86 is engaged with toothed belt 81, centered on pivot shaft 13 and secured to frame members 76,78 by pin 11 so as not to rotate. Note that chain and sprockets may be substituted for the toothed belt 81 and toothed belt gears 84,86. Stride actuator 102 is electrically connected to controller 66 with wires 83 and 16 by conventional means (not shown). When stride actuator 102 is activated, stride adjustment links 2,4 rotate about pivot shaft 13 causing toothed gear 84 and gear shaft 41 to rotate. As stride adjustment links 2,4 are raised upward, gears 92,94 rotate counterclockwise with gear shaft 41 to walk up gear racks 88,90 in such a manner that rocker links 38,40 remain generally vertically unmoved. This is accomplished by the proper sizing of toothed gears 84,86, gears 92,94 and stride adjustment links 2,4. In other words, the rocker pivot 41 is being repositioned along the length of rocker links 38,40. As a result, the stride length of pedals 50,52 can vary from elongate curve 5 to a shorter elongate curve 3 during operation of the apparatus or while stationary. Independent of the stride length, the orientation of elongate curves 3,5 can be changed by actuator 100.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of drive links, each drive link pivotally connected to said crank and configured such that each end of said drive link follows an elongate path;

a pair of rocker links, each said rocker link configured to oscillate about a rocker pivot;

a pair of coupler links, each said coupler link pivotally connected to said crank arm and said rocker link;

a pair of connector links, each said connector link pivotally connected to said rocker link and said drive link said respective connector links and coupler links remain generally parallel throughout their movements;

a pair of path generating linkages, each said linkage including said drive link, said crank, said rocker link, said coupler link and said connecting link configured to guide said first portion of said foot support member along an elongate path;

a pair of rollers, each said roller positioned in said second portion of said foot support member intermediate the ends;

a pair of guides, each said guide connected to said frame and in rollable contact with said roller to cause said second portion of said foot support member to have a back and forth movement;

each said pedal configured to move relative to said framework when the foot of the user is rotating said crank whereby said pedal follows an elongate curve pedal path.

2. The exercise machine according to claim 1 wherein said elongate curve path is generally elliptical in shape.

3. The exercise machine according to claim 1 further comprising arm exercise, said arm exercise operably associated with said rocker links.

4. The exercise machine according to claim 3 wherein said arm exercise comprises a pair of handles, each said handle pivotally connected to said framework.

5. The exercise machine according to claim 1 further comprising a flywheel, said flywheel rotatably connected to said framework and operably associated with said crank.

6. The exercise machine according to claim 5 further comprising a load resistance, said load resistance operably associated with said flywheel, a means for adjustment of said load resistance and, a control system, said control system positioned within reach of the operator whereby said load resistance can be varied during operation of said exercise machine.

7. The exercise machine according to claim 1 further comprising a first actuator, said first actuator operably associated with said rocker pivot and said framework to adjust the stride length of said elongate curve pedal path.

8. The exercise machine according to claim 1 further comprising a pair of stride adjustment links, each stride adjustment link connected to said rocker pivot and pivotally connected to said framework.

9. The exercise machine according to claim 8 further comprising a gear shaft, said gear shaft rotatably attached to each said stride adjustment link and having a gear attached to each end of said gear shaft which is operatively associated with a corresponding said rocker link.

10. The exercise machine according to claim 9 further comprising a toothed belt, said toothed belt engaged with a first toothed belt gear attached to said gear shaft and with a second toothed belt gear attached to said framework.

11. The exercise machine according to claim 1 further comprising a second actuator, said second actuator operably associated with said guide and said framework to adjust the orientation of said elongate curve pedal path.

12. An exercise machine comprising:

a framework, said framework configured to be supported by the floor;

a pair of foot support members, each having a first portion, a second portion and a foot engaging pedal;

a pair of crank arms, each said crank arm rotatably attached to said framework at a common pivot axis positioned forward of an operator;

a pair of drive links, each drive link pivotally connected to a corresponding said crank arm and to said first portion of said foot support member;

a pair of rocker links, each said rocker link operably associated with a corresponding said crank arm and configured to oscillate about a rocker pivot;

a pair of guides, each said guide connected to said framework and operably associated with said foot support member to cause said second portion of said foot support member to have a back and forth movement;

an actuator, said actuator operably associated with said rocker pivot and said framework;

said pedal configured to move relative to said framework when the foot of the user is rotating said crank arms whereby said actuator can reposition said rocker pivot along the length of each said rocker link causing a stride length change to said pedal elongate curve path.

13. The exercise machine according to claim 12 further comprising a pair of stride adjustment links, each stride adjustment link connected to said rocker pivot and pivotally connected to said framework.

14. The exercise machine according to claim 13 further comprising a gear shaft, said gear shaft rotatably attached to each said stride adjustment link and having a gear attached to each end of said gear shaft and operatively associated with a corresponding said rocker link.

15. The exercise machine according to claim 14 further comprising a toothed belt, said toothed belt engaged with a first toothed belt gear attached to said gear shaft and with a second toothed belt gear attached to said framework.

16. The exercise machine according to claim 12 further comprising a load resistance, said load resistance operably associated with said crank arms, a means for adjustment of said load resistance and, a control system, said control system positioned within reach of the operator whereby said load resistance and said actuator can be varied during operation of said exercise machine.

17. The exercise machine according to claim 12 further comprising arm exercise, said arm exercise operably associated with said rocker links.

18. An exercise machine comprising:

a framework, said framework configured to be supported by the floor;

a pair of foot support members, each having a first portion, a second portion and a foot engaging pedal;

a pair of crank arms, each said crank arm rotatably attached to said framework at a common pivot axis positioned forward of an operator;

a pair of drive links, each drive link pivotally connected to a corresponding said crank arm and to said first portion of said foot support member;

a pair of rocker links, each said rocker link operably associated with a corresponding said crank arm and configured to oscillate about a rocker pivot;

a pair of guides, each said guide connected to said framework and operably associated with said foot support member to cause said second portion of said foot support member to have a back and forth movement;

a first actuator, said first actuator operably associated with said rocker pivot and said framework;

a second actuator, said second actuator operably with said guides to reposition said guides relative to said framework;

said pedal configured to move relative to said framework when the foot of the user is rotating said crank arms whereby said first actuator can reposition said rocker pivot along the length of each said rocker link causing a stride length change to said pedal elongate curve path and said second actuator can change the orientation of said pedal elongate curve path.

19. The exercise machine according to claim 18 further comprising arm exercise, said arm exercise operably associated with said rocker links.

20. The exercise machine according to claim 18 further comprising a load resistance, said load resistance operably associated with said crank arms, a means for adjustment of said load resistance and, a control system, said control system positioned within reach of the operator whereby said load resistance, said first actuator and said second actuator can be varied during operation of said exercise machine.

* * * * *